United States Patent [19]

Takacs

[11] 4,074,384

[45] Feb. 21, 1978

[54] RIVER RAMP FOR HOVERCRAFT

[76] Inventor: James D. Takacs, Rte. No. 1, Box 250, Grove, Okla. 74344

[21] Appl. No.: 717,572

[22] Filed: Aug. 26, 1976

[51] Int. Cl.[2] ..... E01D 1/00

[52] U.S. Cl. ..... 14/1; 14/69.5; 404/1; 61/30; 61/67

[58] Field of Search ..... 14/1, 27, 69.5; 404/1; 61/67, 30

[56] References Cited

U.S. PATENT DOCUMENTS

| | | | |
|---|---|---|---|
| 697,202 | 4/1902 | Donne | 61/67 |
| 1,401,374 | 12/1921 | Swonger | 14/1 X |
| 2,366,916 | 1/1945 | Le Tourneau | 14/1 |
| 2,826,771 | 3/1958 | Pruess | 14/69.5 |
| 3,164,965 | 1/1965 | Martin | 14/69.5 X |
| 3,654,652 | 4/1972 | Pleasants | 14/1 |
| 3,894,307 | 7/1975 | Delamare | 14/1 X |

*Primary Examiner*—Nile C. Byers

*Attorney, Agent, or Firm*—Robert D. Yeager; Howard G. Massung

[57] ABSTRACT

Apparatus for the traversal of an air boat or hovercraft over river dams consisting of a two-sided ramp having an upper and lower end. The ramp is constructed in a river extending over a dam. The upper end of the ramp is located upstream of the dam and the lower end of the ramp is located downstream of the dam. Both the upper and lower ends of the ramp are at least partially submerged to permit easy access by a hovercraft. The angle of intersection of the lower end of the ramp with the water, of the upper end of the ramp with the water, and of the upper and lower ends of the ramp is made large enough so that a commercial hovercraft can traverse thereover. In one embodiment of the invention, side flanges are provided extending along the ramp to prevent an air boat once upon the ramp from passing prematurely to either side.

6 Claims, 4 Drawing Figures

RIVER RAMP FOR HOVERCRAFT

BACKGROUND OF THE INVENTION

1. Field of the Invention

This invention relates to river travel and more particularly to ramps for traversing river dams to provide for hovercraft passage.

2. Description of the Prior Art

Navigable rivers and other water ways have been extensively used for transportation and geographical areas proximate to such water ways have enjoyed rapid development. The rivers of the United States today are used extensively for transportation of bulk materials such as coal, gravel, bulk chemicals and raw materials for industry. The bulk cargoes are particularly adaptable for river transportation due to the large capability of barges and tankers which far exceed trucks, railroad cars and most other overland methods of transportation.

Althrough river transportation as a public convenience was used in the past, such use for extensive or even community travel has fallen in disuse since the development of rapid land travel vehicles, such as buses, subways and trains. Presently the overland vehicles are much faster than river transportation.

The duration of river travel time between two points is substantially lengthened due to dams along the water ways. The dams are necessary to provide adequate channel depth and for flood control. Thus it is necessary for a river conveyance to travel through a series of locks to pass the dam and move from one river level to the next. The lock system of traversing dams, although widely accepted, causes considerable delays in the travel along a river.

Very recently boats which travel on a cushion of air have been used for both water and land travel. These boats, generally known as hovercraft or air cushion boats, have a capacity of about fifty people and are an acceptable public conveyance for commuting short distances, such as one hundred miles or less. However, when rivers are used as a suppport for the hovercraft, it is necessary to encounter time delays due to travel through dam locks. The hovercraft are supported on a cushion of air produced by downwardly directed fans or blowers. The air boats are propelled by an aircraft engine which also can provide the cushion of air on which they travel. Various hovercraft have been used on some bodies of water where there are large distances without locks, such as Lake Michigan and the English Channel. However, their use on numerous rivers of the United States have been severely restricted due to their inability to travel rapidly over the numerous dams.

In accordance with the present invention, an apparatus for the traversal of dams by hovercraft is provided which is much faster than passing the craft through a lock.

SUMMARY OF THE INVENTION

An apparatus for permitting the transversal of a river dam by a hovercraft is provided which consists of a double ended ramp having an upper and lower end. The upper end of the ramp is located upstream of the dam and extends from a position submerged in the higher level of water to a location above the dam. The lower end of the ramp extends from a position beneath the water on the lower end of the dam to join the upper end of the ramp. Both the upper and lower ends of the ramp are at least partially submerged with the ramp traversing the dam. The ramp is preferably securely attached to and supported from the river bed so that it is not raised, lowered or affected by movement or height of the stream.

For optimum use, two ramps can be provided extending across the dam, one for upstream travel and the other for downstream travel of hovercraft. The hovercraft which can carry up to fifty passengers at over 50 m.p.h., thus can provide rapid transportation along rivers, away from conjested urban centers. As noted above, a great many urban centers have developed along water ways which are not presently being effectively used for transporting people. The hovercraft ramps are constructed with a small enough slope so that a hovercraft can easily pass up or down the ramp and pass from the upward sloping ramp on one side of the dam to the downward sloping ramp on the other side of the dam without difficulty. In one embodiment of the invention, the ramp can be constructed with sides which act as a safety restraint to prevent an air boat from prematurely passing off of the ramp.

BRIEF DESCRIPTION OF THE DRAWINGS

For a better understanding of the invention, reference may be had to the preferred embodiments shown in the accompanying drawings, wherein.

DETAILED DESCRIPTION OF THE PREFERRED EMBODIMENTS

Figure 1:
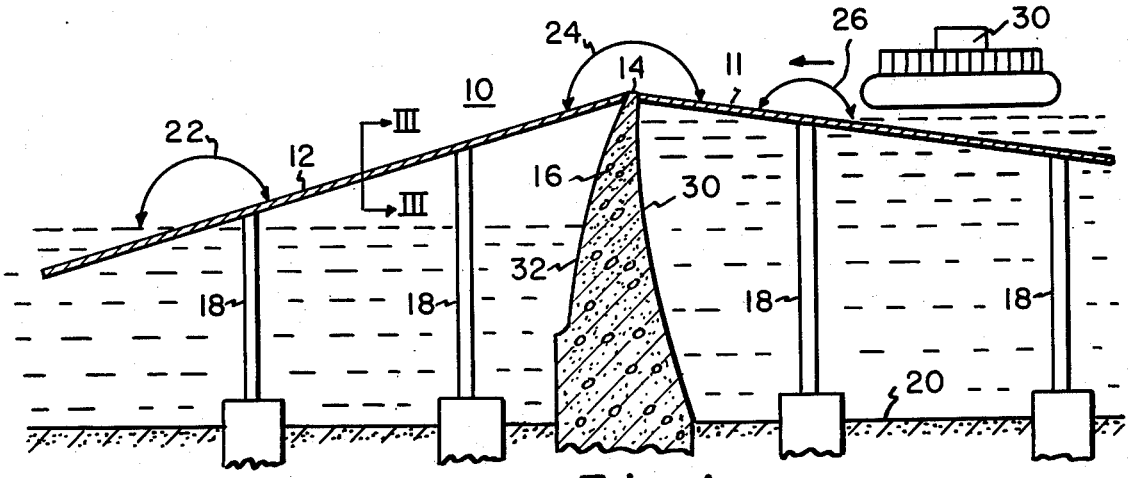
FIG. 1 is a side view partially in section of a dam and river ramp utilizing the teaching of the present invention.

Referring now to the drawings and FIG. 1 in particular, there is shown a ramp 10 constructed in accordance with the teaching of the present invention. Double ended ramp 10 includes an upper side ramp 11 and a lower side ramp 12. The upstream end 11 of ramp 10 extends up to or above the crest 14 of dam 16. Dam 16 retards water and provides a higher water level upstream of the dam than downstream of the dam. Ramp 10 is secured by structural members 18 to bed rock or the river bed 20. Ramp 10 is thus secured in the water and does not move as the level of the water changes due to increased water flow. The lower ramp 12 extends from the river at an angle 22. Ramp 12 extends to the top of or above the crest 14 of dam 16 and connects to upper ramp 11. Ramp 12 connects to ramp 11 at an angle 24. Upper ramp 11 can be completely submerged if the water is flowing over the crest 14 of dam 16 or may make an angle 26 with the upper water level. The angles 22, 24 and 26 are selected to be correct so that a hovercraft 30 can easily pass onto and up either ramp and over the crest of dam 16.

Figure 2:
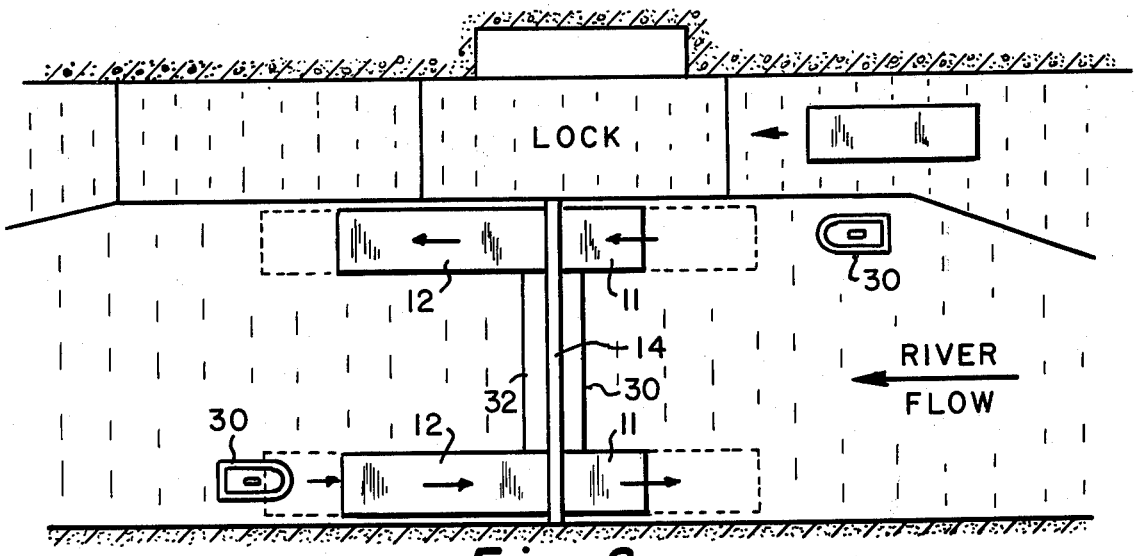
FIG. 2 is a top view of the river and ramp structure according to the teaching of the present invention.
Figure 3:
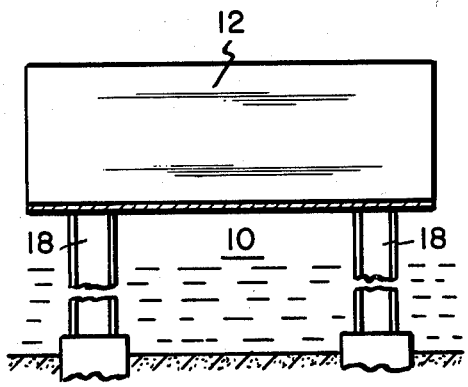
FIG. 3 is a section view of a ramp taken in FIG. 1 along the line III—III.

The upstream end 11 of the hovercraft ramp 10 can be completely submerged up to the crest 14 when a spillway type dam is utilized. This enables an air boat 30 to have a continuous riding surface from the water at the lower side 32 up lower ramp 12 to the crest of the dam 14 where it can again continue riding on the stream at the higher level. When the water level is below peak 14 of dam 12, during a low water period, the upstream end 30 of dam 16 will be partially exposed. This will expose a portion of upper ramp 11. The air boat 30 will then travel up the ramp 12 across the crest 14 of the dam and down ramp 11 onto the upper water surface. As shown in FIG. 2, in a preferred embodiment two ramps are provided, one for upstream travel and another for downstream travel. The ramps 10 can be provided in proximity to lock 36 or on opposite sides of the stream.

Figure 4:
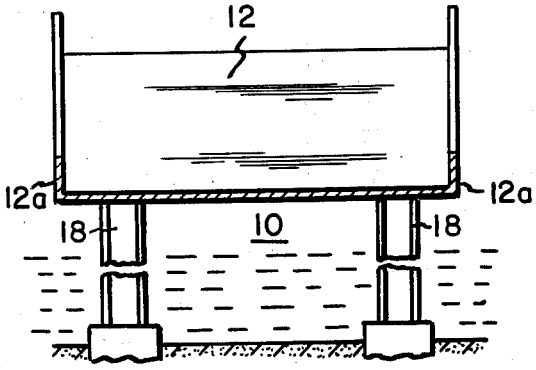
FIG. 4 is a section view similar to FIG. 3 but illustrating an embodiment having side retaining members.

Referring now to FIG. 4, there is shown an embodiment of the invention wherein the ramp 10 is constructed with side flanges or members 12*a* which can direct the hovercraft 30 and prevent it from prematurely passing off of ramp 10. Hovercraft 30 can only ascend a ramp of a predetermined maximum slope so it is important that the ramps are kept close enough to a horizontal orientation to permit easy passage of the craft. Likewise the angle 24 must be properly selected so that the craft 30 can move easily over the top. In the preferred embodiment, angles 22 and 26 are 70° or greater. In some situations it may be desirable to form the ramps 10 with curved sections. For example, rather than having sections 11 and 12 meet at an angle 24 they could be connected by a section having a little curvature.

What is claimed is:

1. Apparatus to provide for the traversal of air boats over river dams comprising:

a ramp having an upper and lower end, the upper end being upstream of a dam and the lower end being downstream of a dam, both the upper end of said ramp and the lower end of said ramp being at least partially submerged in the water and said ramp including a raised portion located intermediate the upper and lower ends and extending above the crest of the dam; and, support means permanently mounting the upper and lower ends of the ramp with respect to the river bottom.

2. Apparatus as claimed in claim 1 wherein:

the angle which the upper end of said ramp makes with the stream is no greater than 20°; and, the angle which the lower end of said ramp makes with the stream is no greater than 20°.

3. Apparatus as claimed in claim 2 comprising:

flange portions extending upward from the side of said ramp.

4. Apparatus to provide for the traversal of a hovercraft over a river dam including a lock comprising:

a ramp having an upper and lower end, the upper end being upstream of the dam and the lower end being downstream of the dam, both the upper end of said ramp and the lower end of said ramp being at least partially submerged in the water;

said ramp including a raised portion located intermediate the upper and lower ends and extending above the crest of the dam; and, support means permanently mounting the upper and lower ends of said ramp with respect to the dam.

5. Apparatus as claimed in claim 4 wherein:

the angle which the upper end of said ramp makes with respect to the stream is no greater than 20°; and, the angle which the lower end of said ramp makes with respect to the stream is no greater than 20°.

6. Apparatus as claimed in claim 4 comprising:

flange portions extending upward from the sides of said ramp.

* * * * *